United States Patent [19]

Reale

[11] Patent Number: 4,837,658

[45] Date of Patent: Jun. 6, 1989

[54] LONG LIFE CORONA CHARGING DEVICE

[75] Inventor: Louis Reale, Rochester, N.Y.

[73] Assignee: Xerox Corporation, Stamford, Conn.

[21] Appl. No.: 284,224

[22] Filed: Dec. 14, 1988

[51] Int. Cl.[4] ..... H01T 23/00

[52] U.S. Cl. ..... 361/230; 361/225

[58] Field of Search ..... 361/212, 220, 225, 229, 361/230–233, 235; 250/324–326; 355/3 CH; 430/902, 903; 422/186.04–186.06

[56] References Cited

U.S. PATENT DOCUMENTS

| | | | |
|---|---|---|---|
| 3,612,864 | 10/1971 | Tamai | 250/324 X |
| 3,675,096 | 7/1972 | Kiess | 250/326 |
| 3,764,866 | 10/1973 | Bonaventura et al. | 361/230 |
| 3,789,278 | 1/1974 | Bingham et al. | 361/229 |
| 4,086,650 | 4/1978 | Davis et al. | 361/229 |
| 4,585,320 | 4/1986 | Altavela et al. | 355/3 CHX |
| 4,585,321 | 4/1986 | Toshimitsu et al. | 355/3 CHX |
| 4,585,322 | 4/1986 | Reale | 355/3 CH |
| 4,585,323 | 4/1986 | Ewing et al. | 355/3 CH |
| 4,646,196 | 2/1987 | Reale | 361/230 |
| 4,792,680 | 12/1988 | Lang et al. | 250/325 |

FOREIGN PATENT DOCUMENTS

| | | | |
|---|---|---|---|
| 2040058 | 11/1984 | Japan | 355/3 CH |

*Primary Examiner*—L. T. Hix
*Assistant Examiner*—Brian W. Brown

[57] ABSTRACT

A corona charging device for depositing negative charge on an imaging surface comprises at least one elongated conductive metal corona discharge electrode supported between insulating end blocks and being coated with a substantially continuous thin conductive dry film of aluminum hydroxide containing conductive particles. The corona discharge electrode may be a thin metal wire or alternatively at least one linear array of pin electrodes and the conductive particles in the coating are graphite particles.

15 Claims, 2 Drawing Sheets

LONG LIFE CORONA CHARGING DEVICE

REFERENCE TO RELATED APPLICATIONS

Reference is hereby made to copending application U.S. Ser. No. 002,100 entitled "Corona Device Having a Beryllium Copper Screen" in the name of Joseph H. Lang et al. filed Jan. 12, 1987, U.S. Pat. No. 4,792,680.

Reference is also made to my following application filed concurrently herewith: U.S. Ser. No. 284,225 entitled "Coated Ion Projection Printing Head" (D/87072).

BACKGROUND OF THE INVENTION

The present invention relates generally to charging devices and in particular to charging devices which produce a negative corona.

In an electrostatographic reproducing apparatus commonly used today, a photoconductive insulating member may be charged to a negative potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development the toner particles are attracted from the carrier particles by the charge pattern of the image areas on the photoconductive insulating area to form a powder image on the photoconductive area. This image may be subsequently transferred to a support surface such as copy paper to which it may be permanently affixed by heating or by the application of pressure. Following transfer of the toner image to the support surface the photoconductive insulating surface may be discharged and cleaned of residual toner to prepare for the next imaging cycle.

Various types of charging devices have been used to charge or precharge photoconductive insulating layers. In commercial use, for example, are various types of corona generating devices to which a high voltage of 5,000 to 8,000 volts may be applied thereby producing a corona spray which imparts electrostatic charge to the surface of the photoreceptor. A particular device may take the form of a single bare corona wire an array of pins integrally formed from a sheet metal member strung between insulating end blocks mounted on either end of a channel or shield. Another device which is frequently used to provide more uniform charging and to prevent overcharging, is a scorotron which comprises two or more corona wires with a control grid or screen of parallel wires or apertures in a palte positioned between the corona wires and the photoconductor. A potential is applied to the control grid of the same polarity as the corona potential but with a much lower voltage, usually several hundred volts, which suppresses the electric field between the charged plate and the corona wires and markedly reduces the ion current flow to the photoreceptor.

While capable of performing satisfactorily it has been observed that after prolonged use, for example in the process of making about 150,000 copies, difficulties are experienced for both thin metal wire corona electrodes and pin electrode arrays. These difficulties take the form of undeveloped streaks being formed in the copies produced resulting in unpredicatable images. While not wishing to be bound to any particular theory, this is believed to be caused by non-uniform corona generation which in turn is believed to be caused in part by each of several corrosion and erosion mechanisms. The corona causes some sputtering of the metal away from the electrode whether it be a wire or pin electrode which in the presence of oxygen and nitrogen in the air forms metal nitrates which deposit at various locations along the corona electrode. Furthermore, if there is any ammonia in the air white whiskers or powder may also be observed building up at various locations on the corona electrode. These reactions are believed to take place within about 1 millimeter of the electrode and the deposits formed on the corona electrode result in a non-uniformity of subsequent corona generated along the length of the electrode producing hot spots, localized corona, in the location of the deposits. It is believed that these hot spots tend to create a higher electrostatic field resulting in non-uniform charging. Furthermore, on a clean corona electrode, the hot spots tend to move along its length and are of a lower intensity than after an extended period of use. As corona electrode ages, the hot spots become more intense and become fixed in location thereby accelerating further corrosion at their locations resulting in increased non-uniformity of corona and thereby non-uniformity of charging of the imaging surface. In addition in the pin-type electrode, the sputtering of metal around the pin results in a collar of deposits which build up around the pin and which eventually results in a periodic non-uniformity such that every other pin is dominant. This results in an as yet unexplainable inactivation of corona generation at every other pin.

Previous attempts to minimize the difficulties associated with the above-described erosion and corrosion processes have included physically periodically wipping the corona electrode with a cloth or foam pad. Alternatively, the corona electrodes have been coated with gold. This is effective although expensive and difficulties are frequently experienced in the adhesion of the gold to the corona electrode since the gold tends to flake. Alternatively, fewer difficulties are experienced with platinum wire as the corona electrode which has a lower rate of degradation.

PRIOR ART

U.S. Pat. No. 4,585,321 Toshimitsu et al. discloses an electrode including a conductive linear member. This conductive linear member consists of a core of tungsten or molybdeum wire with a platinum layer covering the surface of the core. The platinum layer serves to enhance the uniform life and stability of the discharge effect.

U.S. Pat. No. 4,646,196 to Reale describes a corona generating device for depositing negative charge on an imaging surface wherein there is at least one element adjacent the corona discharge electrode capable of absorbing nitrogen oxide species generated by the corona device which has been coated with a substantially continuous thin conductive dry film of aluminum hydroxide which may contain a conductive non-reactive filler such as graphite.

SUMMARY OF THE INVENTION

In accordance with the present invention, a corona generating device for depositing negative charge on an imaging surface is provided wherein the corona discharge electrode is coated with a substantially thin, conductive dry film of aluminum hydroxide containing conductive particles.

In a further aspect of the present invention, the aluminum hydroxide film exist as the unhydrated oxide, a hydrated oxide, aluminum hydroxide or mixtures thereof.

In a further aspect of the present invention, the corona discharge electrode comprises a thin metal wire from about 0.5 to about mils in diameter.

In a further aspect of the present invention, the corona discharge electrode comprises at least one linear array of pin electrodes.

In a further aspect of the present invention, the linear array of pins are beryllium copper alloy containing from about 0.1% to about 2% beryllium.

In a further aspect of the present invention, the conductive particles are graphite particles having a maximum dimension less than about 5 micrometers.

In a further aspect of the present invention, the aluminum oxide-hydrate to graphite weight ratio is from about 1.5 to about 2.2.

In a further aspect of the present invention, the aluminum hydroxide films are from about 0/3 to about 1.0 mil in thickness.

For a better understanding of the invention as well as other aspects and further features thereof, reference is had to the following drawings and descriptions.

DESCRIPTION OF THE PREFERRED EMBODIMENT

Figure 1:
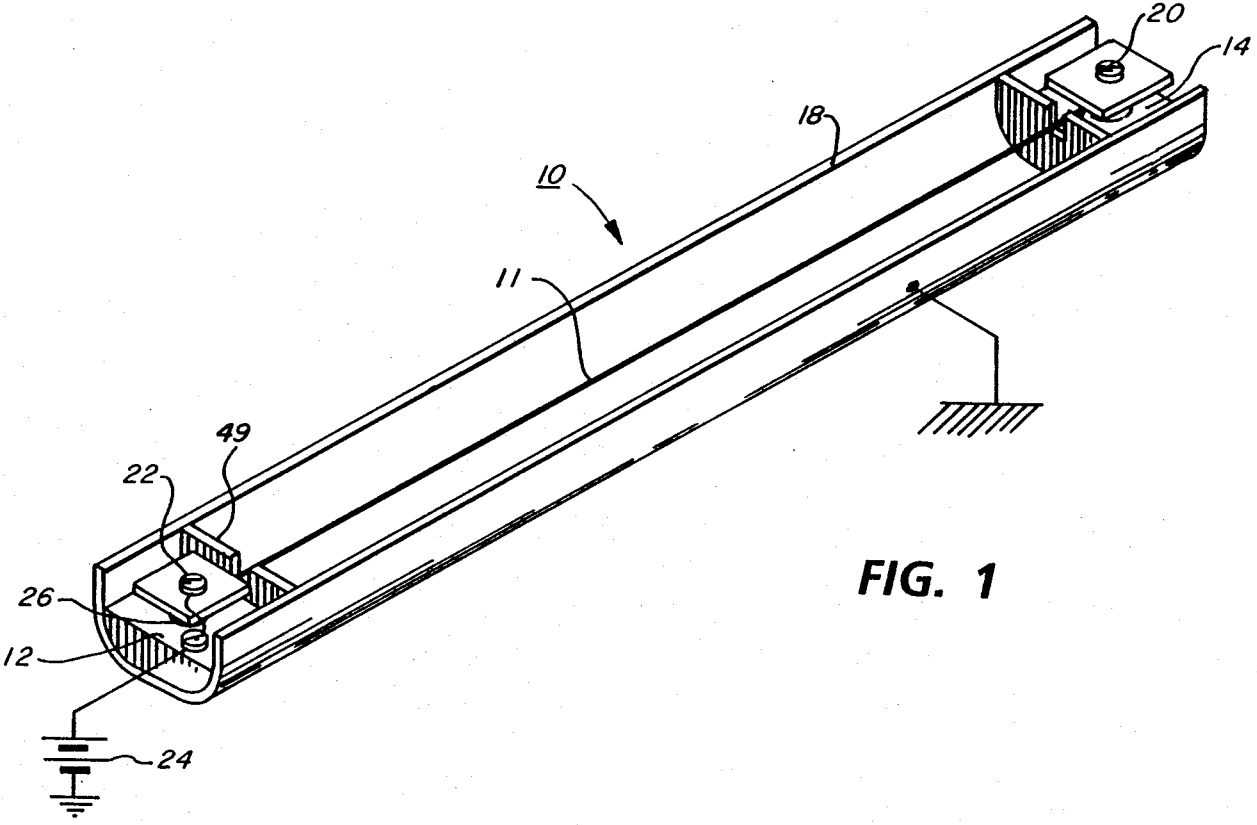
FIG. 1 is an isometric view of a preferred embodiment of a corona generating device according to the present invention wherein the corona discharge electrode is a thin metal wire.

Referring to FIG. 1, the corona generator 10 of this invention is seen to comprise a single wire corona discharge electrode 11 supported between insulating end block assemblies 12 and 14. A conductive corotron shield 18 which is grounded increases the ion intensity available for conduction. Since no charge builds up on the shield, the voltage between the shield and the wire remain constant and a constant density of ions is generated by the wire. The effect of the grounded shield is to increase the amount of current flowing to the plate. The corona wire 11 at one end is fastened to port 20 in the end block assembly and at the other end is fastened to port 22 of the second end block assembly. The wire 11 at the second end of the corona generating device is connected to a corona potential generating source 24 by lead 26. Such a device might have utility as a precharge corona generating device. The wire 11 may be made of any conventional conductive filler material such as stainless steel, gold, aluminum, copper, tungsten, platinum or the like. The diameter of the wire is not critical and may vary typically between about 0.5 and about 4 mils and preferably is about 2 mils. The wire 11 has a substantially continuous thin uniform conductive coating of aluminum hydroxide along its length as will be described hereinafter.

Figure 2:
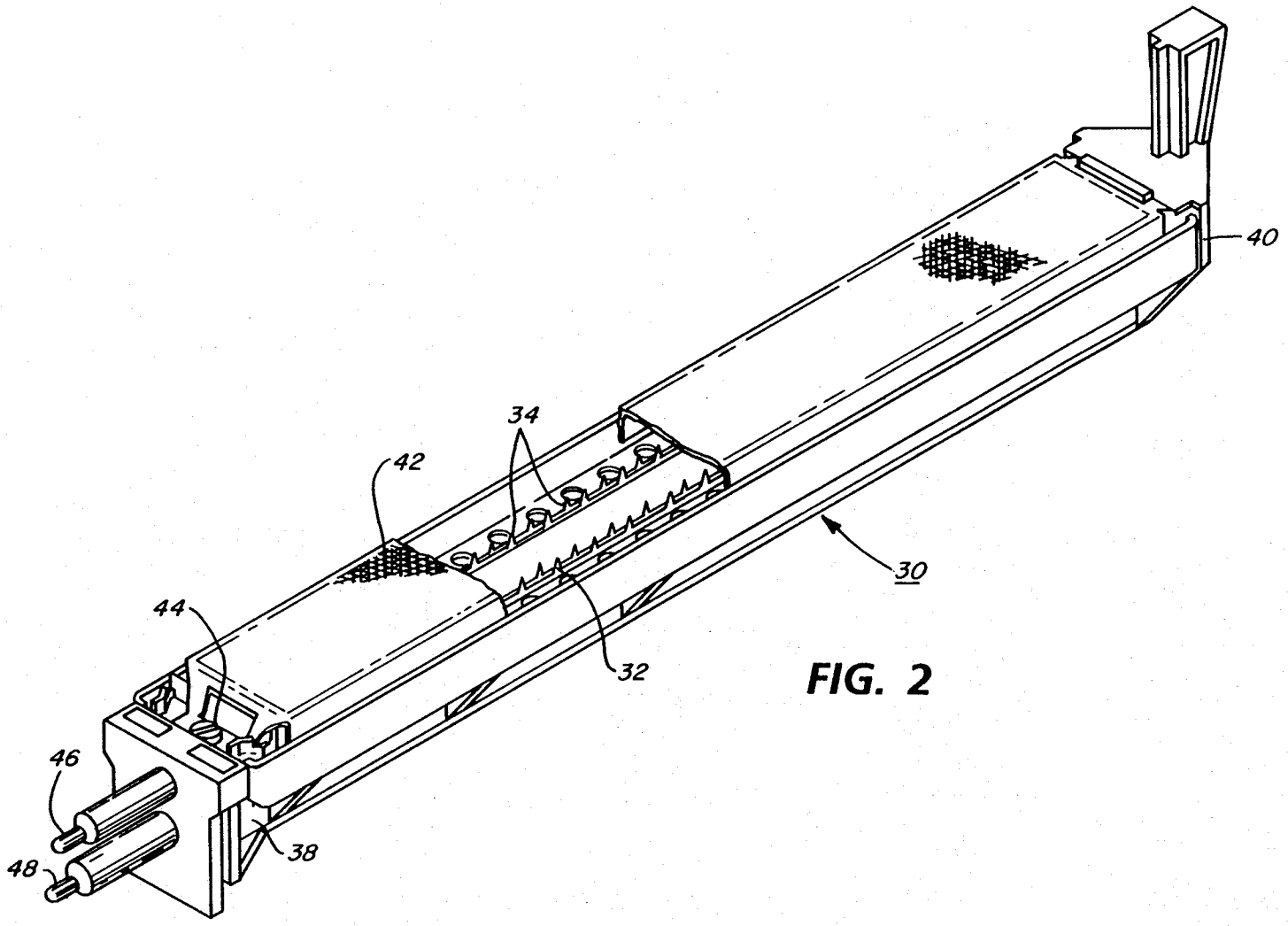
FIG. 2 is an isometric view of another preferred embodiment of a corona generating device according to the present invention wherein the corona discharge electrode comprises at least one linear array of pin electrodes.

FIG. 2 illustrates an alternative preferred embodiment according to the present invention. In FIG. 2, scorotron 30 is represented as including two linear pin electrode arrays 32 and 34 supported between insulating end block assemblies 38 and 40. A conductive corona control grid 42 is placed on top of the linear pin arrays and anchored in place by means of screw 44 to potential generating source by lead 46. Both of the linear pin electrode arrays 32 and 34 are connected to potential generating source 48. Such a device might have utility as a negative charging corona generating device wherein the potential from a high voltage DC power supply applied to the grid is about −800 volts or very close to the voltage desired on the imaging surface which is closely spaced therefrom. The potential applied to the two linear pin electrode arrays is in the range of from about −6,000 to about −8,000 volts. The entire assembly is supported by being clamped between three injection molded plastic support strips. In this configuration the two linear pin coronodes in the shape of a saw tooth provide vertically directional fields and currents due to their geometry providing a higher efficiency of current to the photoconductor versus the total current generated. The grid acts as a leveling device or reference potential limiting the potential on the substrate being charge. In accordance with the present invention, the linear pin electrode arrays 32 and 34 are coated with a substantially continuous thin conductive dry film of aluminum hydroxide containing conductive particles.

In a preferred embodiment, the pins in the pin electrode array are made of beryllium copper alloy in which the beryllium is present in amount of between about 0.1% to about 2.% by weight. Such an array is preferred because of relative ease of monofactorability and its spring properties. The single corona wire 11 in FIG. 1 and the pin arrays 32 and 34 in FIG. 2 are coated with a substantially continuous thin conductive film of aluminum hydroxide containing conductive particles. Preferably the aluminum hydroxide is applied to the corona electrode in aqueous media providing a somewhat gelatinous coating which is subsequently readily dehydrated by driving off the water. The adherent film formed on drying is believed to exist as the unhydrated aluminum oxide, a hydrated oxide or aluminum hydroxide or mixtures thereof. The film forming properties may be improved by the addition of small amounts of water soluble binders such as polyvinylpyrolidone or polyvinyl alcohol. One percent by weight of solids may be adequate without imparing water resistance of the dry film. To impart the desired conductivity to the film, it also contains a conductive non-reactive filler such as graphite. Graphite is particularly preferred in this application since it functions as a conductor, it is chemically inert only forming carbon dioxide and provides a lubricity to the coating. The particle size of the graphite is significant particularly with the small diameter wires. Typically, the filler such as graphite has a maximum dimension less than 5 micrometers. It is desired generally to provide a small diameter wire as the corona electrode which enables the use of lower voltage with which to achieve the desired corona level and thereby enables the use of smaller and cheaper power supplies. Accordingly, when using small diameter wires, it is necessary to control the particle size of the graphite to ensure a substantially uniform continuous film.

Typical formulations to be applied to the corona electrodes comprise aluminum oxide-hydrate and conductive filler such as graphite in a weight ratio of from about 1.5 to about 2.2 of aluminum oxide-hydrate to graphite dispersed in aqueous medium to provide from about 10% to 30% by weight solids. A particularly preferred formulation comprises by weight 77.5 percent water, about 14.5 percent aluminum oxide-hydrated and about 7 percent graphite and about 1 percent polyvinylpyrollidone and has a PH of 7.

The substantially continuous thin conductive dry film of aluminum hydroxide may be formed on the corona electrode by applying an aqueous solution or dispersion as a thin film thereto. Upon heating the liquid film dehydrates to provide a strong rigid inorganic adhesive bond to the substrate. Typically, the films can be applied to a previously degreased electrode by spraying or brushing as with a paint or by dip coating so as to provide a uniform coherent film on the electrode. Typically, the film is applied in a thickness of from about 0.3 to about 1 mil and preferably 0.5 mil as a substantially uniform continuous layer without pores. It has been found that a very uniform layer may improve the geometry of the device since the film may tend to level off any irregularities such as burrs formed during stamping of the array.

The manner in which the aluminum hydroxide film functions to minimize the erosion and corrosion is not fully understood. However, it is believed that a non-reactive coating similar to glass is provided which is much more inert than the bare metal of the corona electrode and that a high binding energy coating is provided which adheres to the substrate without flaking off. In addition, in the preferred embodiment with the presence of graphite in the coating an electrode is provided which is relatively easy to clean due to the lubricity of the graphite.

To test the efficiency of the substantially continuous thin conductive dry films of aluminum hydroxide according to the present invention, a pin scorotron as used in the Xerox 1065 and similar to that shown in FIG. 2 was tested. One-half of the pin scorotron was coated with an aluminum hydroxide film according to the present invention and one-half was not coated with the aluminum hydroxide film. The previously degreased pin scorotron having 188 beryllium copper alloy pins 2 mm apart was coated with Electrodag 121 an aqueous dispersion of semicolloidal graphite in an organic binder which cures at 350° C. in one hour to form a hard conductive coating and which is available from Acheson Colloid Company, Port Huron, Mich. The dispersion which is believed to contain 77.5 percent by weight water, 14.5 percent aluminum oxide hydrated, 7 percent by weight graphite and about 1% by weight polyvinylpyrolidone was applied to one half of the scorotron by dip coating followed by drying in air.

The pin scorotron was placed in a Xerox 1065 duplictor and a uniform gray test pattern was placed on the platen. The initial copies produced on the uniform gray test pattern showed no difference between the two halves corresponding to the coated and uncoated areas of the pin scorotron. The pin scorotron was removed from the Xerox 1065 and placed in a text fixture for a life test during which it was turned on and off, occasionally being observed, and being left on for a total time equivalent to that necessary to form 250,000 copies after which it was returned to the Xerox 1065 for additional reproduction of the uniform gray test pattern on the platen. The copies produced showed severe streaking in the area corresponding to the bare half section of the pin array with the formation of a large number of white lines in the developed gray area. The area on the copiers corresponding to the coated half of the pin scorotron showed minimal evidence of streaking. In addition, the uncoated section of the pin scorotron when visibly observed, showed an oxidized discolored appearance with while powder formation while there was negligible change in the appearance of the coated side of the pin scorotron from the initial test. Furthermore, when observing the pin scorotron during corona generation, alternate pin shutdown is observed as a periodic change in coronoa intensity along the length of the uncoated section of the pin array which causes non-uniform charging, thereby creating a streaking problem. On the coated side of the pin array, there was no pin shutdown and charging was substantially uniform with only minimal streaking observed.

Thus, according to the present invention, a substantial extension in the useful life of a corona generating device for depositing negative charge has been achieved. According to the present invention, the presence of streaks of undeveloped areas in copies is avoided by the application of a substantially continuous, thin, conductive dry film of aluminum hydroxide containing conductive particles. Further, more uniform charging of an imaging surface is obtained. This coating is inexpensive, easily applied, has a high voltage resistance, high corrosive chemical resistance and provides an excellent conductive coating for a negative charging corona generating device.

All the patents referred to herein are hereby incorporated by reference in their entirety in the instant specification.

While the invention has been described with reference to specific embodiments, it will be apparent to those skilled in the art that many alternatives, modifications and variations may be made. For example, while the invention has been illustrated as useful in making prints from a copying device, it will be understood that it has equal application to the making of prints in printer applications wherein the images are created electronically. It is intended to embrace such modifications and alternative as may fall within the spirit and scope of the appended claims.

I claim:

1. A corona generating device for depositing a negative charge on an imaging surface carried on a conductive substrate held at a reference potential comprising at least one elongated conductive metal corona discharge electorde supported between insulating end blocks, means to connect said electrode to a corona generating potential source, said discharge electrode being coated with a substantially continuous thin conductive dry film of aluminum hydroxide containing conductive particles.

2. The corona generating device of claim 1, wherein said film is from about 0.3 to about 1.0 mil in thickness.

3. The corona generating device of claim 1, wherein the aluminum hydroxide film exists as the unhydrated oxide, a hydrated oxide, aluminum hydroxide or mixtures thereof.

4. The corona generating device of claim 1, wherein said corona discharge electrode comprises a thin metal wire from about 0.5 to 4 mils in diameter.

5. The corona generating device of claim 1, wherein said at least one elongated conductive corona discharge electrode comprises at least one linear array of pin electrodes.

6. The corona generating device of claim 5 wherein said pins of said at least one linear array of pins are beryllium copper alloy.

7. The corona generating device of claim 6 wherein said beryllium copper alloy comprises from about 0.1% to 2.0% by weight beryllium.

8. The corona generating device of claim 1 wherein said conductive particles are graphite particles having a miximum dimension less than 5 micrometers.

9. The corona generating device of claim 8, wherein said film is at least about 0.5 mil in thickness.

10. The corona generating device of claim 8, wherein the aluminum hydroxide film exists as the unhydrated oxide, a hydrated oxide, aluminum hydroxide or mixtures thereof.

11. The corona generating device of claim 10 wherein the aluminum oxide-hydrate to graphite weight ratio is from about 1.5 to about 2.2.

12. The corona generating device of claim 10, wherein said corona discharge electrode comprises a thin metal wire from about 0.5 to 4 mils in diameter.

13. The corona generating device of claim 8, wherein said at least one elongated conductive corona discharge electrode comprises at least one linear array of pin electrodes.

14. The corona generating device of claim 13 wherein said pins of said at least one linear array of pins are beryllium copper alloy.

15. The corona generating device of claim 14 wherein said beryllium copper alloy comprises from about 0.1% to 2.0% by weight beryllium.

* * * * *